US010584479B2

(12) United States Patent
Saenz Saenz

(10) Patent No.: US 10,584,479 B2
(45) Date of Patent: Mar. 10, 2020

(54) METHOD FOR CONSTRUCTING BUILDINGS HAVING A RETICULAR STRUCTURE AND BUILDING CONSTRUCTED USING SAID METHOD

(71) Applicant: Francisco José Saenz Saenz, Lleida (ES)

(72) Inventor: Francisco José Saenz Saenz, Lleida (ES)

( * ) Notice: Subject to any disclaimer, the term of this patent is extended or adjusted under 35 U.S.C. 154(b) by 0 days.

(21) Appl. No.: 16/064,851

(22) PCT Filed: Dec. 9, 2016

(86) PCT No.: PCT/ES2016/070870
§ 371 (c)(1),
(2) Date: Jun. 21, 2018

(87) PCT Pub. No.: WO2017/109245
PCT Pub. Date: Jun. 29, 2017

(65) Prior Publication Data

US 2018/0371742 A1 Dec. 27, 2018

(30) Foreign Application Priority Data

Dec. 21, 2015 (ES) ..... 201531853

(51) Int. Cl.
*E04B 1/35* (2006.01)
*E04B 5/02* (2006.01)
(Continued)

(52) U.S. Cl.
CPC ..... *E04B 1/3511* (2013.01); *E04B 1/02* (2013.01); *E04B 1/21* (2013.01); *E04B 5/02* (2013.01);
(Continued)

(58) Field of Classification Search
CPC .. E04B 1/3511; E04B 1/35; E04B 2001/3588; E04B 2001/199; E04B 2001/2415
See application file for complete search history.

(56) References Cited

U.S. PATENT DOCUMENTS 2,871,544 A 2/1959 Youtz
2,964,143 A 12/1960 Fayeton
(Continued)

FOREIGN PATENT DOCUMENTS

ES 432569 A1 3/1977
ES 2625980 A1 7/2017
(Continued)

OTHER PUBLICATIONS

International Search Report dated Apr. 4, 2017 in connection with International Application No. PCT/ES2016/070870.

*Primary Examiner* — Christine T Cajilig
(74) *Attorney, Agent, or Firm* — Gary J. Gershik; Cooper & Dunham LLP

(57) ABSTRACT

The invention relates to a method for constructing buildings having a reticular structure and to a building constructed using said method. The method comprises the steps of: erecting a set of columns (1, 2, 3, 4) that form the vertical supporting structure, on foundations or piles; arranging, in a lower zone of the structure (100), a heap (5) with fully constructed floor modules (6) inside the space defined by the columns (1, 2, 3, 4) and in the same vertical order as the definitive order planned for each of the floor modules of the structure (100) forming the building; raising the floor modules (6) by means of elevators, to place same in their definitive positions at corresponding heights; and joining the floor modules (6) to the columns (1, 2, 3, 4) by means of screwing, welding, riveting or an equivalent system.

20 Claims, 12 Drawing Sheets

(51) Int. Cl.

| | |
|---|---|
| ***E04B 1/02*** | (2006.01) |
| ***E04B 1/21*** | (2006.01) |
| ***E04B 1/00*** | (2006.01) |
| ***E04B 1/19*** | (2006.01) |

(52) U.S. Cl.
CPC . *E04B 2001/0076* (2013.01); *E04B 2001/199* (2013.01); *E04B 2001/1984* (2013.01); *E04B 2001/3588* (2013.01)

(56) References Cited

U.S. PATENT DOCUMENTS

| | | | | | |
|---|---|---|---|---|---|
| 3,028,707 | A | | 4/1962 | Sagalovitch | |
| 3,053,015 | A | * | 9/1962 | Graham | E04B 1/3511 254/106 |
| 3,713,265 | A | * | 1/1973 | Wysocki | E04B 1/3511 52/125.1 |
| 3,720,034 | A | * | 3/1973 | Dawley | E04B 1/3511 52/169.9 |
| 3,892,055 | A | | 7/1975 | Ljung | |
| 3,974,618 | A | * | 8/1976 | Cortina | E04B 1/3538 52/745.14 |
| 9,493,940 | B2 | * | 11/2016 | Collins | E04B 1/24 |
| 2010/0235206 | A1 | * | 9/2010 | Miller | E04D 3/352 705/7.11 |

FOREIGN PATENT DOCUMENTS

| | | | |
|---|---|---|---|
| GB | 919 601 | A | 2/1963 |
| GB | 1082615 | | 9/1967 |
| WO | WO 2015/131334 | A1 | 9/2015 |

* cited by examiner

METHOD FOR CONSTRUCTING BUILDINGS HAVING A RETICULAR STRUCTURE AND BUILDING CONSTRUCTED USING SAID METHOD

RELATED APPLICATIONS

This application is a § 371 national stage of PCT International Application No. PCT/ES2016/070870, filed Dec. 9, 2016, claiming priority of Spanish Patent Application P201531853, filed Dec. 21, 2015, the contents of each of which are hereby incorporated by reference into this application.

TECHNICAL FIELD OF THE INVENTION

The present invention relates to a method of constructing buildings having a reticular structure, a method comprising the emplacement "in situ" of prefabricated slabs, strongly attached to the vertical columns of the reticular structure.

The present invention also relates to a building constructed in accordance with the aforementioned method.

BACKGROUND OF THE INVENTION

Numerous methods for constructing frame structures for buildings are known in the state of the art. Such methods, used in constructing the majority of buildings in many cities, are based on a three-dimensional network of latticework of strong vertical elements (pillars and columns) and horizontal elements (beams, joists, girders, tympans and stringers) to distribute and to balance the weight of the structure. These latticework structures are lighter, as they require fewer elements than, for instance, arched structures; thus, buildings of great height can be achieved. The strength-giving elements are attached one to another by means of welding or by bolted joints, depending on the results of the calculations and on the type and degree of elasticity required for the particular building. These structures may be built entirely of, or feature elements of, metal, concrete, and even wood.

The most common method of construction consists of a sequential process whereby the pillars are vertically installed, linked at their lower part to the foundations or to piles. Next, the girders are linked to the pillars and subsequently the stringers to the girders, thus completing the metallic structure. Next, the slab is constructed upon the horizontal structure of girders and stringers. The slab is the load-bearing structure of the floor, responsible for distributing the stresses to the girders and also horizontally. Currently, a very common example may be found in the combined steel and concrete slabs, or "composite slabs", normally consisting of steel girders or stringers, a ribbed steel sheet ("composite deck") disposed upon the girders and stringers, and finally a compression layer of concrete, with supplementary reinforcement.

Finally, the work may be finished by paving with floor tiles on the concrete. Alternatively, the use of technical floors or ceilings is currently very common, wherein piping, nodes and utilities outlets (water, electricity, optic fibre for communications, hot air for heating and cold air for air conditioning, underfloor heating, domotics, sensorics, etc.) are installed in the ceiling below the joists and stringers, or on the cement forming the floor, subsequently to be covered with parquet flooring sheets, or vinyl or PVC tiling on a supporting framework, in the case of flooring.

On the one hand, the constriction of a slab is a highly labour and time intensive process, as it consists of a batch of various sequential stages, wherein the next stage must await the completion of the previous stage. Here, the construction of the slab represents a bottleneck, as it is necessary to wait for the concrete to set. On the other hand, the installation of the utilities also requires a considerable amount of labour. Therefore, the labour factor represents one of the most significant items in the cost of construction of building structures with utilities included. Finally, the vertical divisions and façade must be installed.

The inventors have performed a background study and have concluded that document WO2015131334A1 may be quoted as the closest state of the art. The patent application PCT WO2015131334A1 describes a method for the construction of buildings wherein the slabs, prefabricated and equipped at source with horizontal beams and stringers, are placed by means of cranes upon the main girders and beams attached to the columns or pillars of the building. The object of this patent enables the achieving of economy in its construction, but presents the drawback that the slab of each storey must be hoisted "in situ" at the workface by large, costly cranes and, furthermore, the construction of vertical walls or divisions, and also the façade, is still required, and a solution is not provided to the financial drawback of having to construct and install ceilings, flooring and utilities once the slabs are in place.

The object of the present invention is to provide a simultaneous solution to these issues and drawbacks.

EXPLANATION OF THE INVENTION

To this end, the object of the present invention, in a first aspect, is an innovative method of constructing buildings having a reticular structure, new in concept and in function, which is characterised essentially in that it is comprised of the following stages:

- Erecting a set of columns forming the vertical load-bearing structure on foundations or piles;
- Arranging, at the lower part of the structure, a pile of fully constructed storey modules, within the space defined by the columns, and in the same order in a vertical direction as the definitive order foreseen for each of the storey modules of the structure forming the building;
- Hoisting the storey modules by means of elevators until they are positioned in their definitive emplacements at their corresponding heights; and
- Attaching the storey modules to the columns by means of bolting, welding, riveting or equivalent procedure.

In accordance with another characteristic of the present invention, the method provides, at each storey module, the slab corresponding to one of the floors, and at least one of the following construction elements, to be selected from among the following set:

- The main girder or beam of the storey slab;
- The joists or secondary beams of the storey slab;
- The base of the storey above the floor, possibly including a floor slab, paving and/or screed;
- The ceiling of the storey below the storey, possibly including an enclosing surface;
- Vertical division elements, such as interior walls and building façades;
- Horizontal protrusions in projection from the structure, such as balconies.

In accordance with another characteristic of the present invention, each storey module is constituted by two halves of the storey, said halves being linked by means of bolting once disposed side-by-side in their respective positions at the workface.

In accordance with a preferred characteristic of the present invention, the storey modules are hoisted by means of an elevation system.

Preferably, although not exclusively, the elevation is executed by means of cranes installed at the apex of the columns, in collaboration with pull cables to hoist the storey modules vertically upwards.

In a particular case, the final storey module corresponds to the roof of the building.

In a particular embodiment of the invention, the storey modules comprise the deck of an upper storey, the horizontal slab, the horizontal load-bearing joists and stringers, and the ceiling of the storey below.

In the preferred embodiment, the storey modules hoisted include the piping and service outlets for electricity, signal, water and ventilation for the lower storey, and illumination, domotics, signage, and optionally an enclosure equipped with ventilation outlets and grilles, luminaires, smoke detectors, etc., for the lower floor.

The stage of hoisting the storey modules preferably includes the guiding of the slabs via a number of protrusions on the columns, these acting as a slide for the guides disposed on the storey modules.

Preferably, the stage of attaching the storey modules includes the supporting of the storey modules on brackets incorporated in the columns; said brackets being articulated in order to open with the passage of the storey modules and to spring back once the storey module has passed, activated by a number of return springs, and then a structural girder or beam from the storey is attached to the column by bolting.

In one variant, the vertical division elements, such as the internal walls and the façades of the building, are assembled on the upper face of the storey module, and subsequent to the stage of attaching the storey modules to the columns, they are raised and affixed to the structure, forming the divisions and façades of the upper storey.

Alternatively, the vertical division elements, such as the internal walls and the façades of the building, are assembled on the lower face of the storey module, and subsequent to the stage of attaching the storey modules to the columns, they are lowered and affixed to the structure, forming the divisions and façades of the storey below.

A single storey module can incorporate both vertical and horizontal divisions simultaneously.

In a second aspect of the present invention, a building constructed in accordance with the method above is provided.

BRIEF DESCRIPTION OF THE DRAWINGS

A detailed description of preferred, but not exclusive, embodiments of the method for constructing buildings having a reticular structure, which is the object of the invention, is given below; for the better understanding thereof a set of drawings is attached wherein, by way of a non-limitative example, embodiments of the present invention are portrayed.

In said drawings.

DETAILED DESCRIPTION OF THE DRAWINGS

Figure 1:
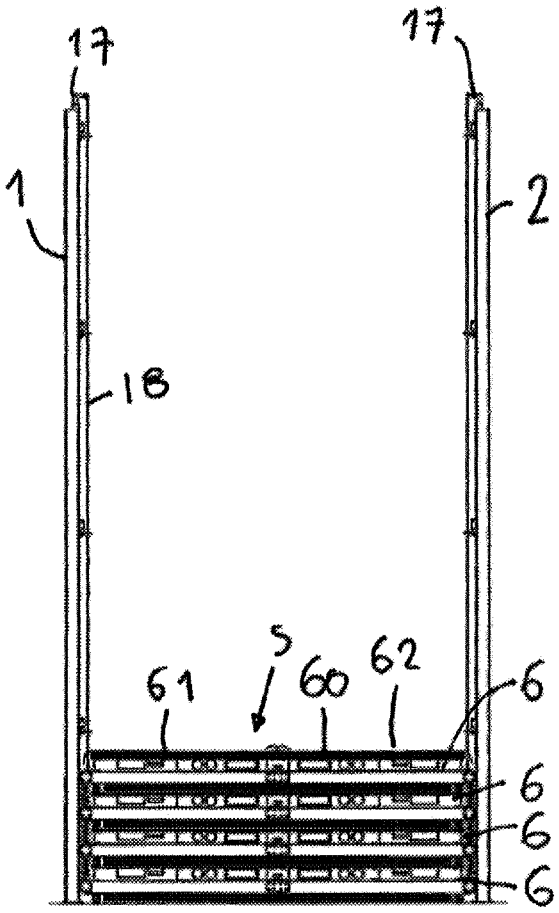
FIGS. 1 to 7 are frontal elevational views of the respective phases of the stage of hoisting the storeys, by means of elevators, until they are positioned in their definitive emplacements at their corresponding heights.
Figure 2:
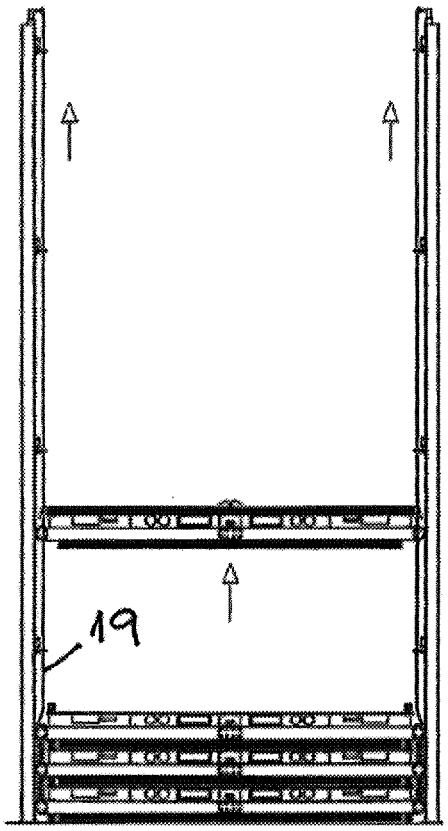
Figure 3:
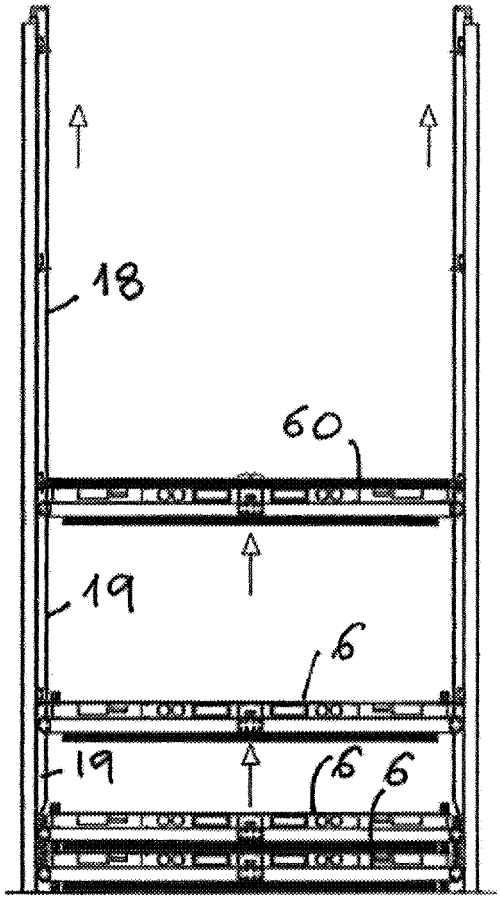
Figure 4:
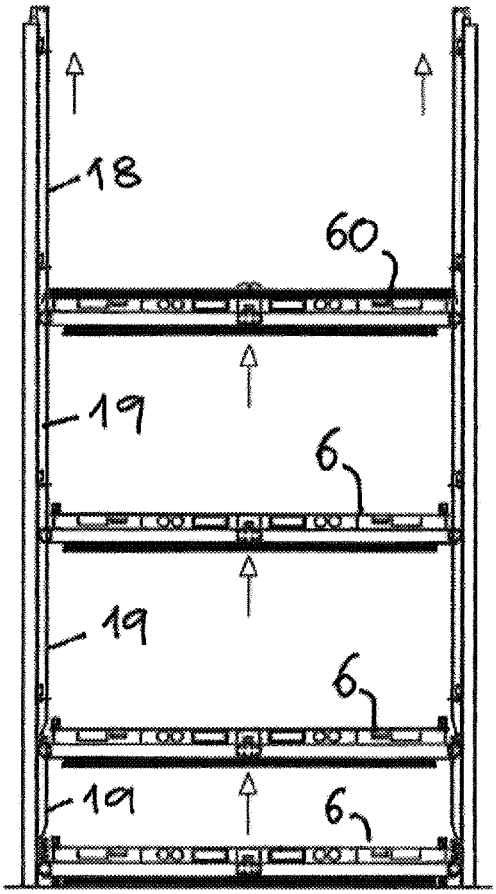
Figure 5:
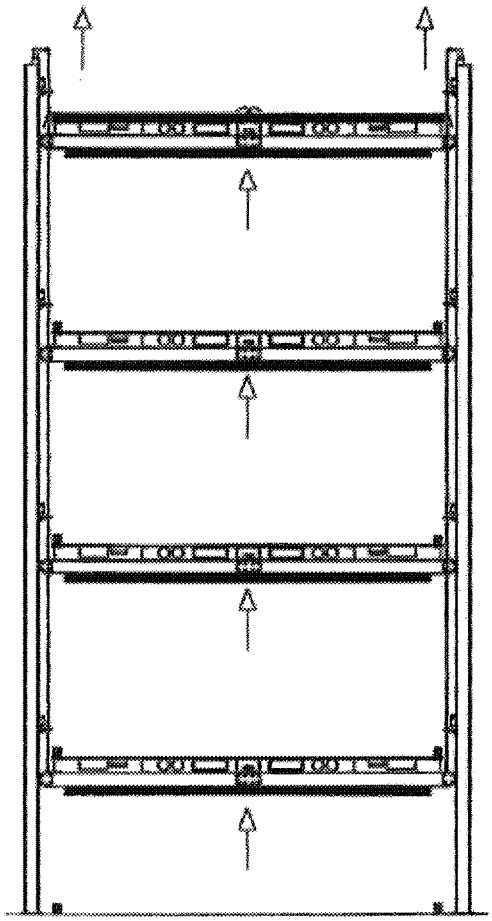

In said drawings, the operational mode and the advantages of the method of construction of buildings 101 having a reticular structure 100, in accordance with the present invention, may be clearly seen.

The method is applicable to buildings of the type comprising the emplacement "in situ" of prefabricated slabs, which are strongly attached to the vertical columns (1-4) of the reticular structure by means of bolting, welding, riveting or equivalent procedure.

The invention is based on the following stages:

Erecting a set of columns (1, 2, 3, 4) forming the vertical load-bearing structure on foundations or piles (not portrayed in the drawings);

Arranging, at the lower part of the structure 100, a pile 5 of storey modules 6, fully prefabricated and factory-made, within the space defined by the columns 1, 2, 3, 4 and in the same vertical order as the definitive order foreseen for each of the storey modules 6 of the structure 100 forming the building;

Hoisting simultaneously the set of storey modules 6, by means of hoisting systems of varying types, for instance cranes or winch engines, until they are positioned in their definitive emplacements at their corresponding heights; and Attaching the storey modules 6 to the columns 1, 2, 3, 4, resting on the same by means of brackets 8 by means of an appropriate technique: bolting, welding, riveting or equivalent procedure.

The columns (1-4) may be particularly metal profiles of any type, such as HEB, IPE or IPN profiles, although the inventors have foreseen that the vertical structure may be partially or totally made from other construction materials, for example concrete.

In accordance with an essential characteristic of the method of the invention, each storey module 6 should be prefabricated in its entirety, featuring at source the slab 7 corresponding to one of the floors, and one or several of the following strengthening construction or installation elements:

The deck 20 of an upper storey, possibly including a floor slab and paving;

The main girder or beam 10 of the storey slab 7;

The joists or secondary beams 15 of the storey slab 7;

The ceiling 30 of the floor below the storey 6, possibly including an enclosing surface;

Vertical division elements, such as interior walls and the façades of the building 101;

Horizontal protrusions in projection from the structure, such as balconies; and

In the preferred embodiment of the invention, which greatly facilitates the transport and installation of the storey modules, these are formed by two halves 61, 62 of the storey.

As the typical measurement of the spaces between the columns of buildings is 6×6 metres or similar, it seems appropriate that a storey module 6 can be prepared in two half-sections 61, 62, measuring 3×6 metres each; these can be carried in a standard truck container, with no need for recourse to heavy haulage, which would increase the expense of the transport. Both halves 61, 62, once unloaded from the transport, are linked together by means of bolting once disposed side-by-side in their respective positions at the workface.

Next, the hoisting of the storey modules 6 is executed by means of cranes or winch engines, installed preferably at the apex of the columns (1-4), in collaboration with pull cables to hoist the storey modules 6 vertically upwards and in unison. To this end, the consecutive storey modules 6 are linked by means of cables (19).

In a preferred embodiment, the final storey module 6, or upper module 60, is that which corresponds to the roof of the building 101, and incorporates the corresponding enclosure elements.

FIGS. 1 to 7 portray phases of the stage of hoisting the storey modules 6 by means of elevation equipment, until their positioning in their definitive emplacements at their corresponding heights. FIG. 1 portrays the pile 5 of storey modules 6 disposed between the columns 1 to 4 of the structure 100. Motors 17 are disposed at the apex of the columns, in order to hoist the storey modules 6 upwards, by means of cables 18 linking the motor 17 to the first storey module 60, and by means of cables 19 linking together the different storey modules 6, in such a way that each hoists the next module immediately below.

Figure 6:
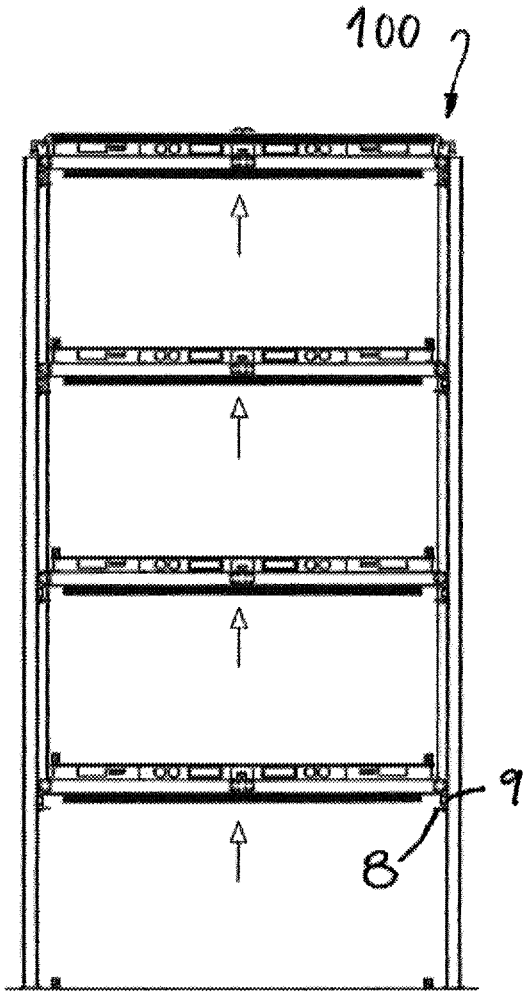
Figure 7:
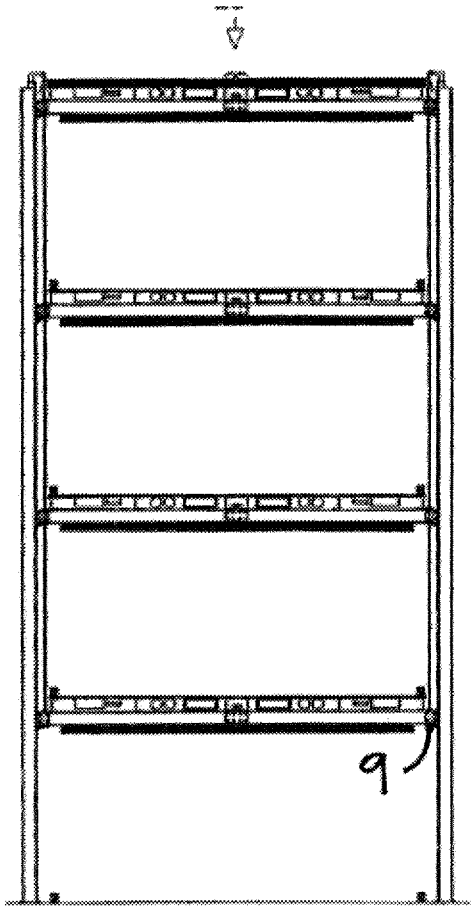

FIGS. 2 to 6 portray successive phases wherein the storey modules 6 are hoisted simultaneously upwards until they surpass the brackets 8, in FIG. 6. The final phase is portrayed in FIG. 7, wherein the storey modules 6 have descended slightly, so as to remain resting, via the beams 10, on the corresponding brackets 8 of the columns (1-4).

Below, with regard to FIGS. 18 to 24, a more detailed explanation of the execution of this support and the joining of the storey modules 6 to the beams (1-4) is given.

Figure 8:
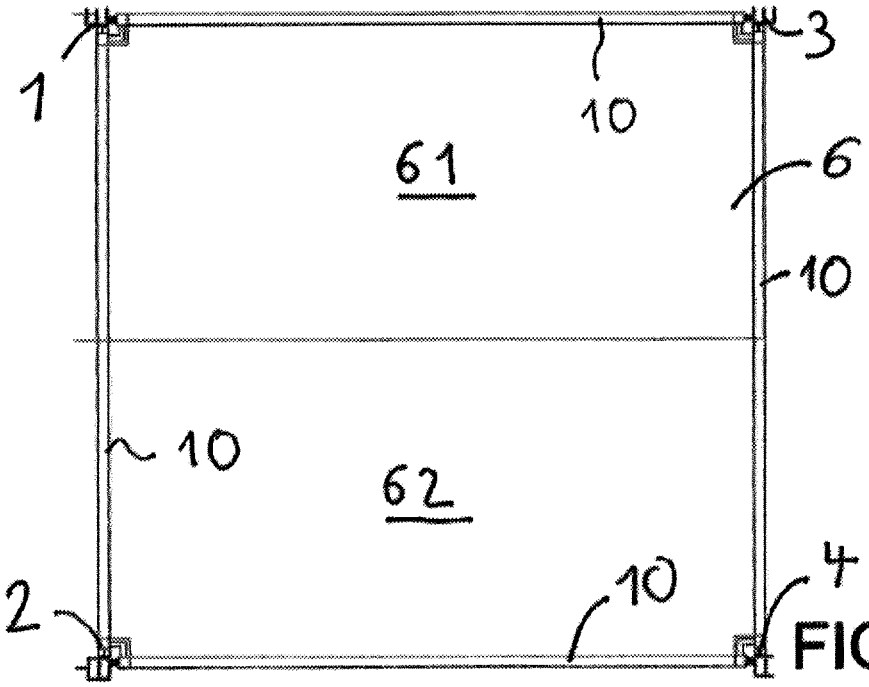
FIG. 8 is a plan view of the disposition of a storey module, hoisted, deposited and anchored to the vertical structure.

FIG. 8 is a plan view of the disposition of a storey module 6 once hoisted, deposited and anchored to the vertical structure.

Figure 9:
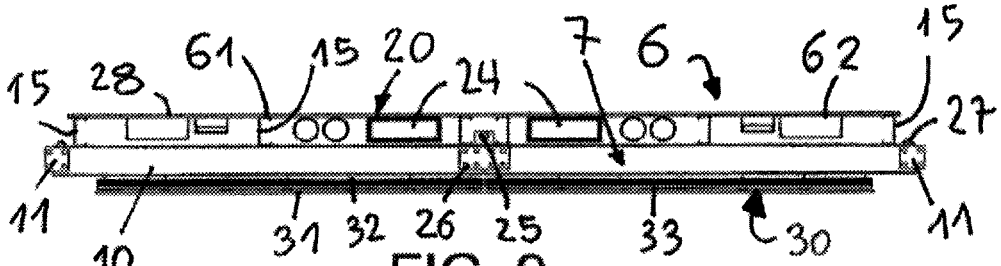
FIGS. 9 and 10 are two lateral elevational views portraying the possible embodiments of the storey modules in accordance with the present invention.
Figure 10:
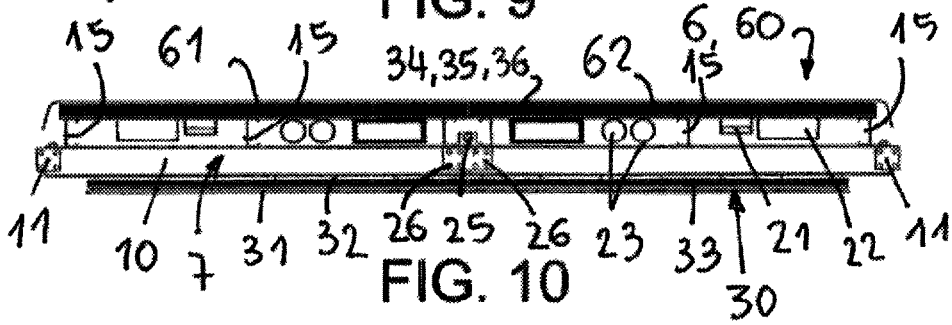

FIG. 9 portrays a partial cross-sectional view of the composition of an example of a storey module 6 for a pair of regular storeys, while FIG. 10 is an analogous view portraying a storey module 60 corresponding to the flat roof of the building.

In both FIGS. 9 and 10 it may be seen that the storey modules 6, 60 feature slabs 7 which include a main load-bearing girder or beam 10, and secondary joists or stringers 15. The beam 10 may be a HEB-, IPE- or IPN-profile or other metal girder, and the stringers 15 may be of any type, for example cold-rolled metal C or Z profiles, or even HEB, IPE, IPN or other laminated profiles. In the storey module 6, 60, the installation of metal, plastic or other channelling 21, 22 for the passage of electrical, telecommunications, lighting installations and other utilities, and a number of pipes 23 for the passage of fluids. It may also be seen in FIGS. 9 and 10 that the modules feature ducts 24 for ventilation and air conditioning.

A fastening profile 25 links the half-slabs 61, 62 of the module 6, 60 via the interior of an overlapping pipe between halves 61 and 62. This fastening profile may be seen slightly above the linking plates 26 of the two halves 61, 62 of the module.

At the extremities of the beams 10 a number of plates 11' and 11" may be seen; the function thereof being to link the storey modules 6 to the columns 1-4. A number of welded eyebolts 27 are provided for the hoisting system.

A water-repellent panel 28 seals the upper surface of the module 6 and also enables the supporting of the deck 20 of the storey, to be covered with the appropriate flooring material; parquet, tiling, PVC, etc.

Figure 16:
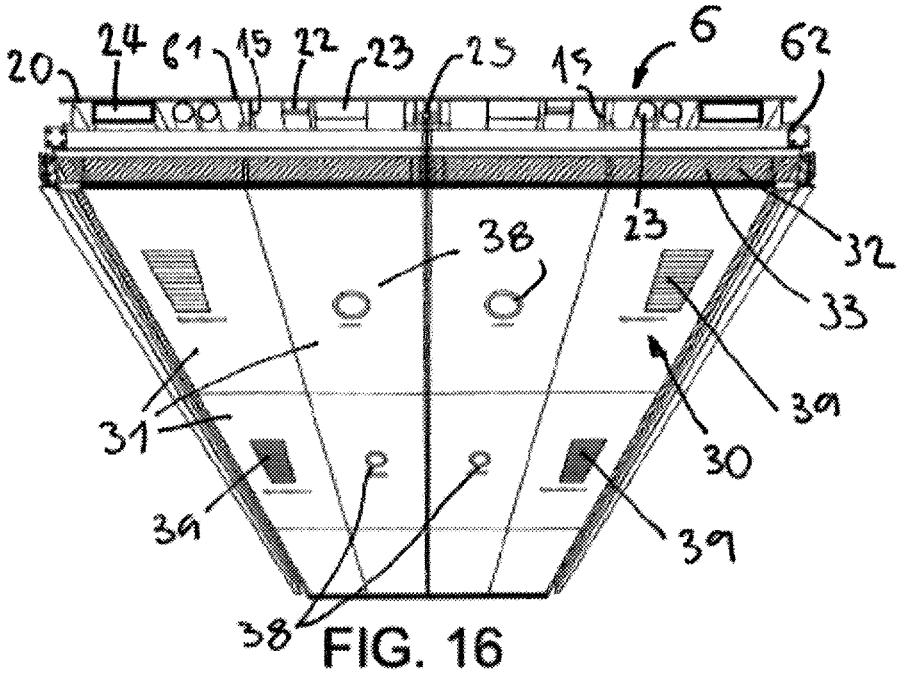
FIG. 16 is a perspective view portraying, seen from below, an embodiment of the ceiling of a storey.

Below the beam 10 there is an auxiliary structure forming a false ceiling 32, with thermal and/or acoustic insulation, and a number of false ceiling plates 31 may cover a lower portion of the module 6, 60, and may incorporate luminaires, diffusers, smoke detectors, water sprinklers, motion sensors, light sensors, or other installations related to domotics or the internet of things, all installed priorly at source. FIG. 16 portrays a perspective view of an example of this construction.

Figure 17:
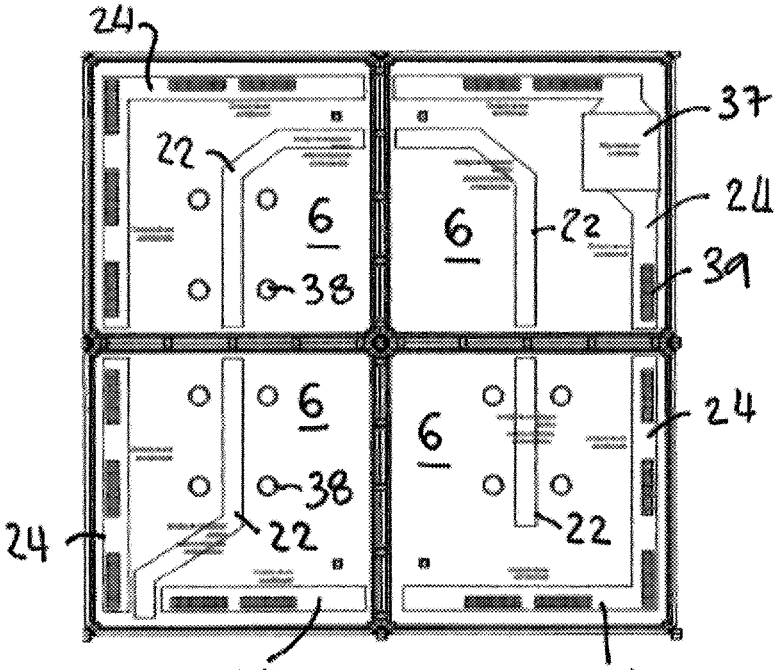
FIG. 17 is a plan view from below portraying a possible embodiment of the ceiling of a storey, or of part of a storey of a building constructed from the storey modules of the present invention.
Figure 18:
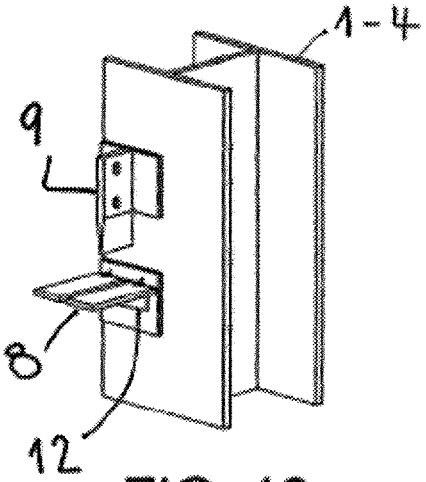
FIG. 18 is a perspective view portraying the protrusion of the guiding mechanism for the storeys, corresponding to the column.

FIG. 17 portrays an example of a completed false ceiling, incorporated in the storey modules 6, 60, wherein an example may be seen of how the cooling and heating machinery 37, the junction boxes, cable trays 22 and the air ducts 24 with their diffusers 38 and return grilles 39, and the conduits for all the installations executed in any type of building 101, are all incorporated in the modules 6, 60 in accordance with the invention, thanks to a prior design for each project, or alternatively, they may be standardised. The storey modules 6 may be prefabricated according to the design required for each, so that when the modules are hoisted and fitted, the pathways of the installations follow the predesigned routes. Once the entire building 101 has been hoisted, the installations of each storey module 6 are connected so as to form the storey, and the passage of the cables may be commenced, by means of guidewires or cable lead-throughs priorly installed in the trays. All of the above simplifies greatly the work of the fitters.

In one variant (not portrayed), the primary girder or beam 10 is at the highest point, and the joists 15 and facilities are below.

In another possibility, the slab 7 may be supplemented, as required by calculations, with a metal composite deck filled with concrete, and to bear thereon the necessary flooring, with parquet, tiles, PVC, etc.

In the storey module forming the roof 60 in FIG. 10, it may be seen that the assembly is completed superiorly with enclosing elements, such as an insulating sandwich board 34, waterproofing 35 or water-repellent panelling 36 of the thickness required by calculation.

Figure 11:
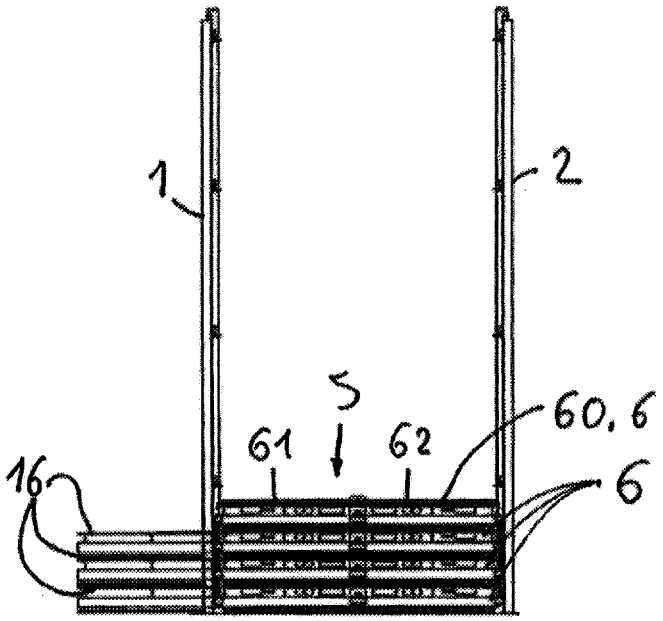
FIGS. 11 to 13 are three frontal elevational views of the respective phases of the storey hoisting stage, in the case of storeys featuring balconies.
Figure 12:
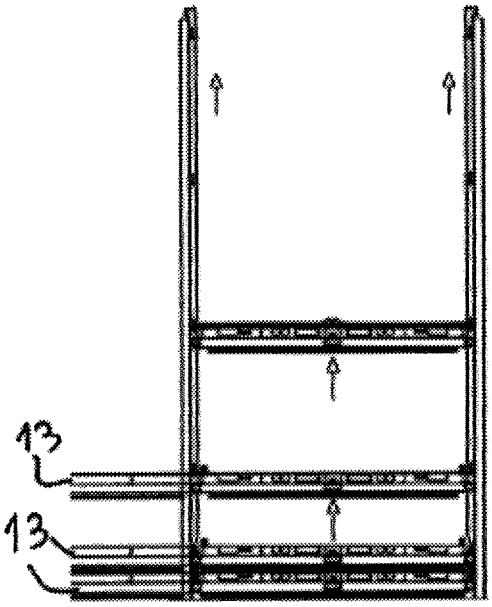
Figure 13:
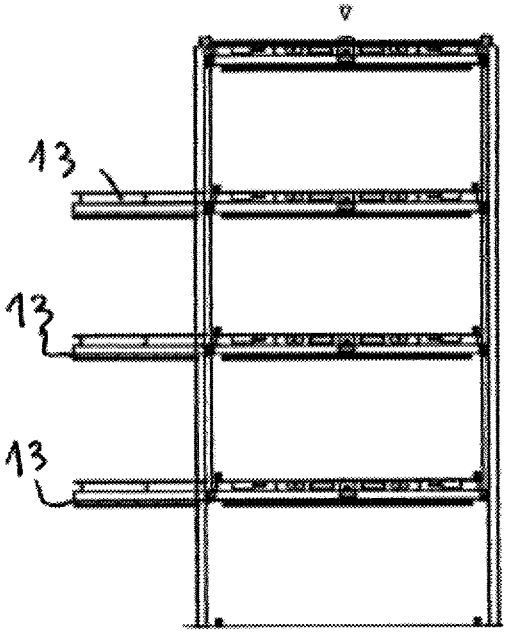
Figure 14:
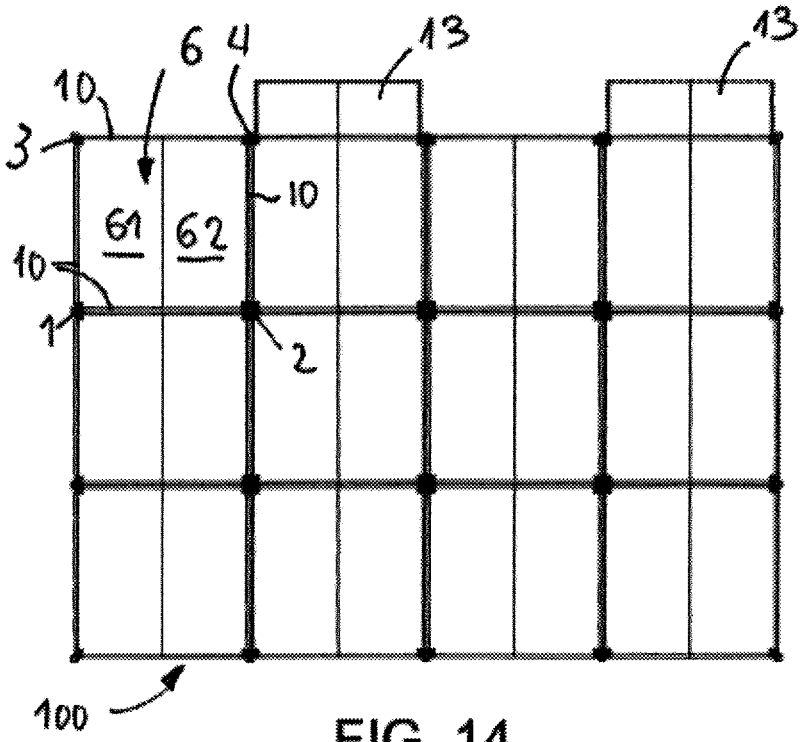
FIG. 14 is a plan view portraying how the balconies in FIGS. 11 to 13 would be located.
Figure 15:
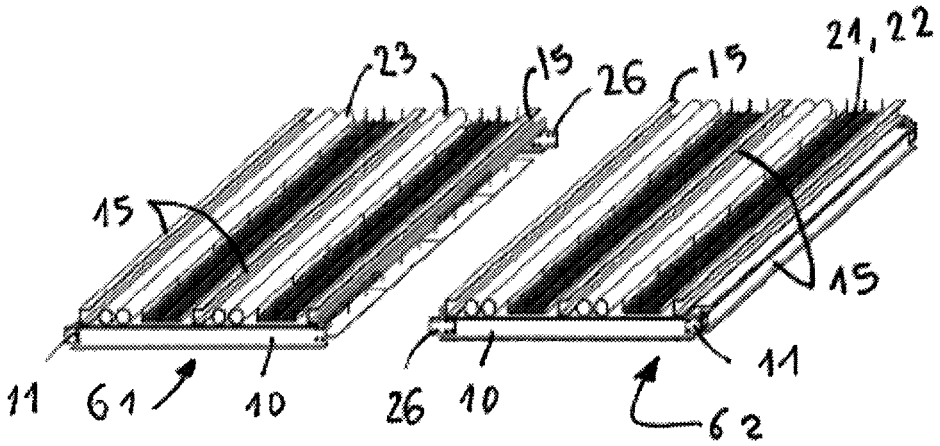
FIG. 15 is a perspective view portraying the interior of two halves of a storey module of the invention, prior to their assembly.

FIGS. 11, 12 and 13 portray three steps of the hoisting of the storey modules 6 of the structure 100 which incorporate protrusions or balcony modules 40, subsequent to their attachment to the main girders or beams 10. They may even be assembled with the definitive handrails or barrier. A plan view of the location of the balcony-modules 40 may be seen in FIG. 14.

Figure 19:
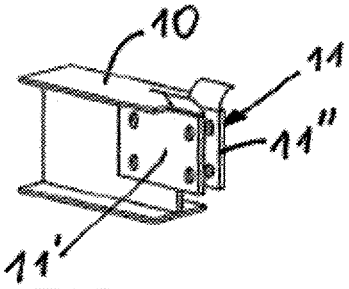
FIG. 19 is a perspective view portraying the slide of the guiding mechanism for the storeys, and the linking plates disposed on the edge of the beam of a storey module in accordance with the present invention.

To guide the hoisting of the storey modules 6, the columns (1-4) feature a number of protrusions 9 (FIG. 18) acting as a slide for a number of guides 11 disposed on one of the beams 10 of the storey modules 6 (FIG. 19). The guides 11 are formed from two plates 11' and 11" on the sides of the web of the beam 10.

To attach the storey modules 6 to the structure 100, the columns 1, 2, 3, 4 are equipped with a number of articulated brackets 8, especially designed to open for the passage of the storey module 6 on being pushed upward by the edge of a beam 10 of the latter, and adapted to spring back due to the effect of a return spring 12 when the storey module 6 has surpassed it in height. The structural girder or beam 10 of the module 6 is attached to the corresponding column 1-4 by resting the edge of the beam 10 on the bracket 9 and affixing the same by means of bolting the plates 11' and 11" to the protrusions 9 of the beams (1-4).

Figures 20, 21, 22:
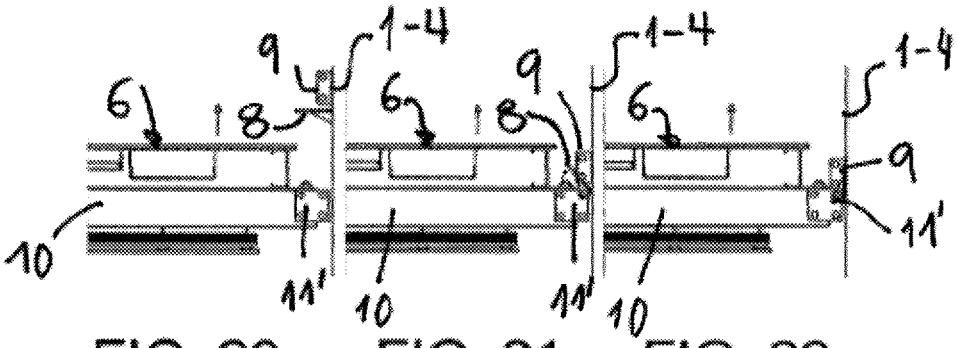
FIGS. 20 to 24 are lateral elevational views portraying the corresponding phases of the stage of positioning the storey modules in their definitive emplacement, resting against the brackets of the columns.
Figures 23, 24:
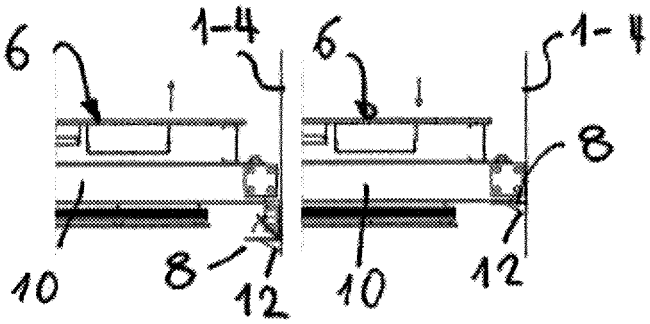

FIGS. 20 to 24 portray successive phases of how the resting and attachment take place. In FIG. 20, the storey module 6 is rising and is below the bracket 8. In FIG. 21, plates 11' and 11" on the edge of the beam 10 enter into contact with the bracket 8 and start to push the latter upward, against the action of a spring 12. In FIG. 22 the bracket is completely folded against the flange bf the column and the guide 11 is passing by the protrusion 9. In FIG. 23, the beam 10 ceases to push against the bracket 8 which, due to the action of the return spring, returns to its horizontal operational position. In FIG. 24, the beam 10 together with the storey module 6 are lowered onto the bracket 8, on which it rests and to which it is bolted. Welding may also be employed.

Figure 25:
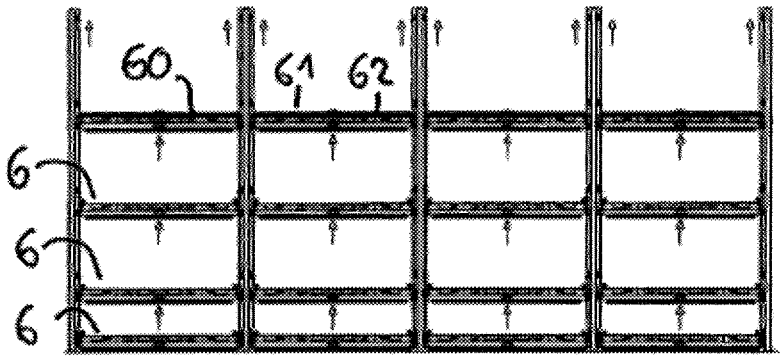
FIGS. 25 and 26 portray two different methods for the hoisting of the storey modules from the pile of modules, corresponding to a building whose plan view is that of FIG. 27.
Figure 26:
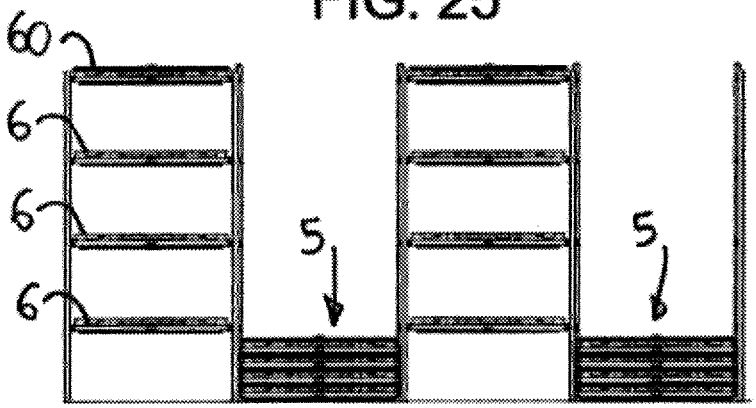
Figure 27:
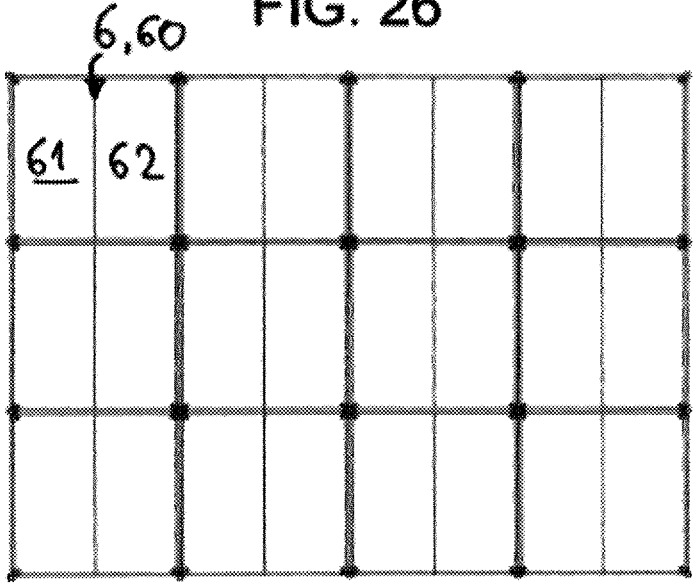
FIG. 27 is a plan view of the building in FIGS. 25 and 26.

FIGS. 25 and 26 portray two possible methods for erecting the storey modules 6 of the building 101 when there is a plurality of modules 6 to form a common storey of the building 101, to be hoisted as one pile 5 for every 4 columns, to form the structure of the floor in FIG. 27, for instance. In this example, it is a question of hoisting 12 piles 5 of modules. In a first case (FIG. 25) the modules 6 of all the piles 5 are hoisted simultaneously, and in the second case (FIG. 26) alternate piles 5 are hoisted.

Figure 28:
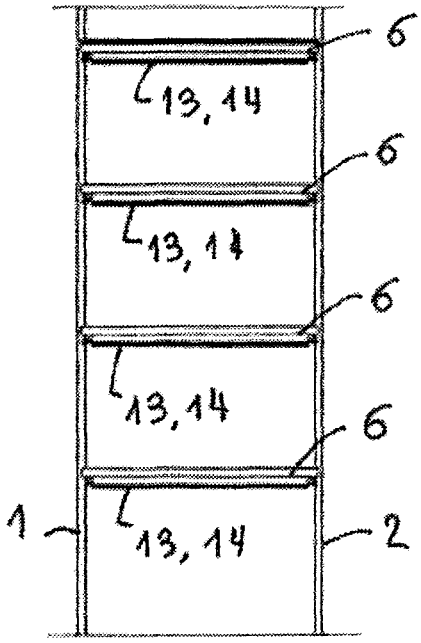
FIG. 28 is an elevational view of a set of storey modules when installed, the storey modules thereof including vertical divisions, such as walls and façades.

The walls 13 and façades 14 of the building 101 may be pre-installed on the storey module 6, as portrayed in FIG. 28, wherein a plurality of storey modules 6, hoisted and joined, may be seen.

Figure 30:
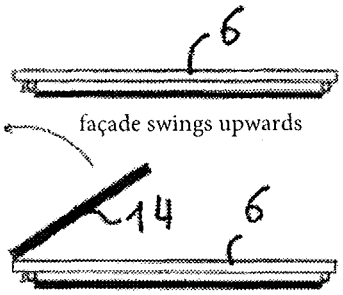
FIG. 30 portrays an alternative embodiment wherein the façades or walls swing upwards.

In FIG. 30 a case is portrayed wherein the interior walls 13 and façades 14 are assembled on the upper part of the storey module 6, and subsequent to attaching the storey modules 6 to the columns 1-4, the walls 13 or façades 14 are raised and affixed to the structure 100, forming the walls 13 and façades 14 of the floor above.

Figure 29:
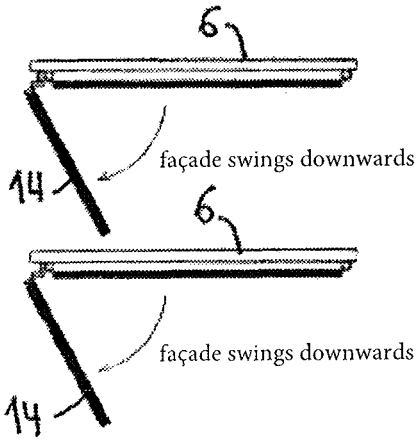
FIG. 29 portrays an embodiment wherein the façades or walls swing downwards.

FIG. 29 portrays the opposite case, wherein the interior walls 13 and façades 14 are assembled on the lower part of the storey module 6, and subsequent to attaching the storey modules 6 to the columns 1-4, the walls 13 or façades 14 are lowered and affixed to the structure 100, forming the walls 13 and façades 14 of the floor below.

Figure 31:
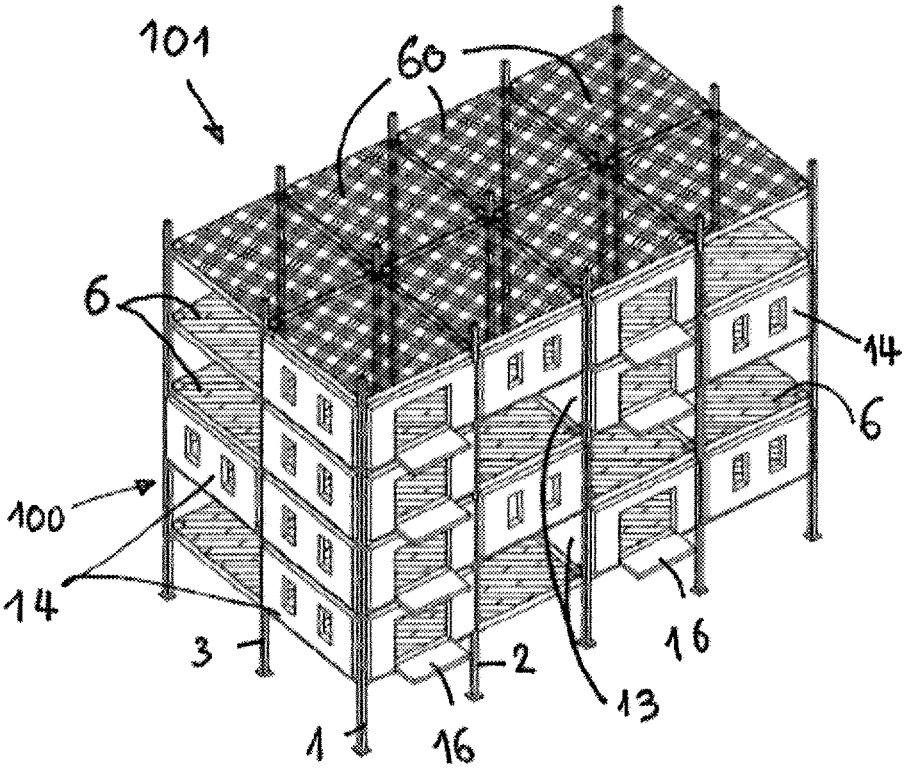
FIG. 31 is a perspective view portraying a building in accordance with the invention, with the storeys completely formed, with façade and wall elements erected from the storey modules, and with projections or balconies at some of its storeys.

Finally, FIG. 31 portrays a building 101 in accordance with the invention, having a reticular structure 100, with the storeys totally formed, with the façade 14 and wall 13 elements erected from the storey modules 6, and with protrusions or balconies 16 at some of the storeys.

The nature of the present invention having been sufficiently described, likewise the method for putting the same into practice, it is stated that anything that does not alter, change or modify the fundamental principle thereof shall be subject to variations in detail.

The invention claimed is:

1. A method of constructing one or more buildings each having a reticular structure (100), of the type comprising emplacement "in situ" of plural constructed storey modules (6), attached to vertical columns (1, 2, 3, 4) of the reticular structure (100) at plural heights, respectively, within a space defined by the vertical columns (1, 2, 3, 4), by means of bolting, welding, or riveting, the method comprising:

(a) erecting a set of the vertical columns (1, 2, 3, 4) forming a vertical load-bearing structure;

(b) arranging, at a lower part of the structure (100), a pile (5) of the plural constructed storey modules (6), within the space defined by the columns (1, 2, 3, 4), and in a same vertical order as a definitive order foreseen for each of the storey modules (6) of the structure (100) forming a building amongst the one or more buildings;

(c) hoisting the plural storey modules (6) by means of an elevation system until each storey module (6) is positioned in a definitive emplacement at a corresponding height amongst the plural heights within the space defined by the columns (1, 2, 3, 4); and (d) attaching each of the plural storey modules (6) to the columns (1, 2, 3, 4) by means of bolting, welding, or riveting, wherein (d) includes resting the storey modules (6) on brackets of the columns (1, 2, 3, 4), said brackets being articulated in order to open with passage of the storey module (6) and to spring back once the storey module (6) has passed.

2. The method of constructing said one or more buildings each having a reticular structure (100), as claimed in claim 1, wherein each storey module (6) includes a prefabricated storey slab (7) corresponding to a floor amongst one or more floors in the building, and further includes at least one of the following construction elements, to be selected from among the following set:

a main girder or beam (10) of the storey slab (7);

joists or secondary beams (15) of the storey slab (7);

a deck (20) of the storey module (6) above the floor of the storey module (6), including a floor slab and/or paving;

a ceiling (30) of a storey module (6) below the floor of the storey module (6), including an enclosing surface;

vertical division elements, including interior walls (13) and façades (14) of the building; and horizontal protrusions in projection from the structure (100), including balconies (16).

3. The method of constructing said one or more buildings each having the reticular structure (100), as claimed in claim 1, wherein each storey module (6) is constituted by two half-modules (61, 62), and in that both halves (61, 62) are linked by means of bolting once disposed side-by-side in their respective positions at an area which said one or more buildings are constructed.

4. The method of constructing said one or more buildings each having the reticular structure (100), as claimed in claim 1, wherein the storey modules (6) are hoisted together by means of the elevation system.

5. The method of constructing said one or more buildings each having the reticular structure (100), as claimed in claim 1, wherein the hoisting in (c) is performed by means of cranes or winch engines (17) installed on the columns (1-4) in collaboration with pull cables (18, 19) to hoist the storey modules (6) vertically upwards.

6. The method of constructing said one or more buildings each having the reticular structure (100), as claimed in claim 1, wherein a final storey module (60), amongst the plural storey modules (6), corresponds to a roof of the building.

7. The method of constructing said one or more buildings each having the reticular structure (100), as claimed in claim 1, wherein at least one storey module amongst the plural storey modules (6) comprises:

a deck (20) of an upper storey;

a horizontal slab (7);

stringers (15) and beams (10); and a ceiling (30) of a storey module (6) below said at least one storey module.

8. The method of constructing said one or more buildings each having the reticular structure (100), as claimed in claim 1, wherein each of the plural storey modules (6) hoisted by the elevation system in (c) include one or more of:

conduits and service outlets for electricity and/or telecommunication signals;

a water source and ventilation for a lower storey portion;

illumination sources, domotics, and/or signage; and an enclosure equipped with ventilation outlets and grilles, luminaires, and/or smoke detectors, for a lower floor.

9. The method of constructing said one or more buildings each having the reticular structure (100), as claimed in claim 1, wherein the hoisting in (c) of the plural storey modules (6) includes guiding the plural storey modules (6) via a number of protrusions on the columns (1, 2, 3, 4) which act as a slide for guides disposed on the storey modules (6).

10. The method of constructing said one or more buildings each having the reticular structure (100), as claimed in claim 1, wherein in (d) the brackets are activated to spring back by a number of return springs, and then a structural girder or beam from the storey module (6) is attached to the columns (1, 2, 3, 4) by bolting.

11. The method of constructing said one or more buildings each having the reticular structure (100), as claimed in claim 2, wherein said vertical division elements, including the interior walls (13) and façades (14) of the building, are assembled on an upper part of a storey module (6) amongst the plural storey modules (6), and subsequent to attaching the storey modules (6) to the columns (1, 2, 3, 4) in (d), the vertical division elements are raised and affixed to the structure (100), forming the walls (13) and façades (14) of a floor, amongst the one or more floors in the building, above the storey module (6).

12. The method of constructing said one or more buildings each having the reticular structure (100), as claimed in claim 2, wherein said vertical division elements, including the interior walls (13) and façades (14) of the building, are assembled on a lower part of a storey module (6) amongst the plural storey modules (6), and subsequent to attaching the storey modules (6) to the columns (1, 2, 3, 4) in (d), the vertical division elements are lowered and affixed to the structure (100), forming the walls (13) and façades (14) of a floor, amongst the one or more floors in the building, below the storey module (6).

13. A building having a reticular structure, constructed by means of a method in accordance with claim 1.

14. A building having a reticular structure, constructed by means of a method in accordance with claim 2.

15. A building having a reticular structure, constructed by means of a method in accordance with claim 6.

16. A building having a reticular structure, constructed by means of a method in accordance with claim 7.

17. A building having a reticular structure, constructed by means of a method in accordance with claim 8.

18. A building having a reticular structure, constructed by means of a method in accordance with claim 9.

19. A building having a reticular structure, constructed by means of a method in accordance with claim 11.

20. A building having a reticular structure, constructed by means of a method in accordance with claim 12.

* * * * *